US007872406B2

(12) United States Patent
Matacotta

(10) Patent No.: US 7,872,406 B2
(45) Date of Patent: Jan. 18, 2011

(54) APPARATUS AND PROCESS FOR GENERATING, ACCELERATING AND PROPAGATING BEAMS OF ELECTRONS AND PLASMA

(75) Inventor: Francesco Cino Matacotta, Bologna (IT)

(73) Assignees: Francesco Cina Matacotta, Bologna (IT); Carlo Taliani, Bologna (IT)

( * ) Notice: Subject to any disclaimer, the term of this patent is extended or adjusted under 35 U.S.C. 154(b) by 519 days.

(21) Appl. No.: 11/887,649

(22) PCT Filed: Apr. 5, 2006

(86) PCT No.: PCT/EP2006/003107

§ 371 (c)(1),
(2), (4) Date: Oct. 1, 2007

(87) PCT Pub. No.: WO2006/105955

PCT Pub. Date: Oct. 12, 2006

(65) Prior Publication Data

US 2009/0066212 A1 Mar. 12, 2009

(30) Foreign Application Priority Data

Apr. 7, 2005 (IT) ..... MI2005A0585

(51) Int. Cl.
*H01J 17/26* (2006.01)

(52) U.S. Cl. ..... 313/231.31; 313/141; 315/111.21

(58) Field of Classification Search ..... 313/231.31, 313/141; 315/111.21
See application file for complete search history.

(56) References Cited

U.S. PATENT DOCUMENTS

| | | | | |
|---|---|---|---|---|
| 3,645,786 | A * | 2/1972 | Tannenberger et al. | 427/596 |
| 4,175,235 | A | 11/1979 | Horiike et al. | |
| 4,335,465 | A | 6/1982 | Christiansen et al. | |
| 5,576,593 | A | 11/1996 | Schultheiss et al. | |
| 6,054,016 | A | 4/2000 | Tuda et al. | |
| 2005/0012441 | A1 | 1/2005 | Schulteiss et al. | |

OTHER PUBLICATIONS

Hobel M et al: "Deposition of superconducting YBaCu0 thin films by pseudospark ablation" Applied Physics Letters USA, vol. 56, No. 10, Mar. 5, 1990, pp. 973-975, XP002404719 ISSN: 0003-6951 p. 973, col. 1, lines 18-21; figure 1.
Dediu V I et al: "Deposition of MBa2Cu307-x thin films by channel-spark method" Superconductor Science & Technology UK, vol. 8, No. 3, Mar. 1995, pp. 160-164, XP002404899 ISSN: 0953-2048 the whole document.

(Continued)

*Primary Examiner*—Nimeshkumar D Patel
*Assistant Examiner*—Mary Ellen Bowman
(74) *Attorney, Agent, or Firm*—Marshall, Gerstein & Borun LLP

(57) ABSTRACT

An apparatus and a process for generating, accelerating and propagating beams of electrons and plasma at high density, the apparatus comprising: a first dielectric tube, which contains gas; a hollow cathode, which is connected to said first dielectric tube; a second dielectric tube, which is connected to said hollow cathode and protrudes inside, and is connected to, a deposition chamber; an anode, which is arranged around said second dielectric tube, in an intermediate position; means for applying voltage to said cathode and said anode; means for evacuating the gas from the chamber; and means for spontaneous conversion of gas in the first dielectric tube into plasma.

28 Claims, 3 Drawing Sheets

OTHER PUBLICATIONS

Strikovski M et al: "Parameters that control pulsed electron beam ablation of materials and film deposition processes" Applied Physics Letters AIP USA vol. 82, No. 6, Feb. 10, 2003, pp. 853-855, XP002404900 ISSN: 0003-6951 the whole document.

Jiang Q D et al: "Deposition of YBa2Cu307-x thin films by channel-spark pulsed electron beam ablation" Thin Solid Films Switzerland, vol. 241, No. 1-2, Apr. 1, 1994, pp. 100-102, XP002404901 ISSN: 0040-6090 the whole document.

Jiang Q D et al:"Characterization and in situ fluorescence diagnostic of the deposition of YBa2Cu307-x thin films by pseudo-spark electron beam ablation" Superconductor Science & Technology UK, vol. 6, No. 8, Aug. 1993, pp. 567-572, XP002404902 ISSN: 0953-2048 abstract ; figure 1.

* cited by examiner

- Prior Art -

APPARATUS AND PROCESS FOR GENERATING, ACCELERATING AND PROPAGATING BEAMS OF ELECTRONS AND PLASMA

The present invention relates to an apparatus and a process for generating, accelerating and propagating beams of electrons and plasma, particularly for applications in further methods for processing materials, for example for methods for depositing films or forming nanoclusters of various materials.

BACKGROUND OF THE INVENTION

More precisely, the present invention relates to the generation, acceleration and propagation of pulsed beams of electrons and plasma, which, when directed against targets made of solid or liquid matter, allow to obtain an explosive expulsion of small amounts of matter, a phenomenon known as ablation. It is believed, without intending to be constrained by any mechanism, that this phenomenon is linked to the release of energy carried by the beam not to the surface of the target but below it, so as to produce the explosion of the portion of material that lies below the surface.

It is known in the background art to produce currents of electrons in vacuum by thermoionic emission or by means of discharges and consequently to accelerate these currents in a corresponding voltage field. The current densities that can be achieved in this manner, however, are not sufficient for some applications. In the background art, electrons generated in vacuum have been deposited through a thin sheet in a chamber containing a gas at low pressure. Although in this manner it is possible to obtain, in this low-pressure area, electron currents with a high current density, the quantity of instruments required is very high and the effect is not satisfactory.

U.S. Pat. No. 4,335,465 discloses a method for generating and accelerating electrons and ions by applying a voltage, in which electrodes are provided which, under the influence of a voltage, supply electrons, and in which a gas at low pressure supplies electrons and ions. The electrodes are spaced one another and are shielded toward the outside. There is at least one gas discharge channel, formed by openings which are provided in each electrode and are aligned along a common axis. A gas which can be ionized at low pressure is provided between the electrodes, and the electrodes are connected at such a voltage as to generate substantially a gas discharge known as "pseudo-spark". The current density that can be achieved in the low-pressure gas is substantially higher than the density of a current of electrons or ions in vacuum.

Patent DE 3834402 discloses a process in which a magnetically self-focused electron beam or pseudo-spark discharge is received at the anode output of an electrically insulated quartz tube and is carried therein over a certain distance. A slight curvature of the tube does not have an observable effect on beam transport and consequently facilitates the search for the most suitable angle of impact of the beam on the target. To a certain degree, the tube protects the pseudo-spark chamber from ablation vapors and allows differential pumping due to the small transverse cross-section of the pump. The generation of the beam of electrons with the pseudo-spark chamber is technically complicated, since it is also limited as regards beam power and beam divergence.

U.S. Pat. No. 5,576,593 discloses a particle beam accelerator for generating a beam of electrically charged particles. With this accelerator, particles having a preset charge and mass are extracted from a reservoir and are supplied to an acceleration chamber formed between two different electrical potentials, in order to provide a beam to be used in further processes.

In particular, U.S. Pat. No. 5,576,593 discloses an apparatus for accelerating electrically charged particles. The described accelerator comprises a pulsed plasma reservoir of high particle density, a dielectric tubular chamber with an inside diameter d, which runs from said reservoir, at least two mutually spaced electrodes arranged around the tubular chamber, one electrode being arranged along the inside wall of the reservoir, means for evacuating the dielectric tubular chamber in order to retain only a residual gas charge with a pressure p which is low enough so that the product between the pressure p of the gas and the inside diameter d of the dielectric tube (p×d) is low enough to avoid parasitic discharges in the residual gas charge, means for applying a voltage to the electrodes in order to extract charged particles from the reservoir in the dielectric tubular chamber and accelerate the particles inside it so as to form a beam of charged particles in the dielectric tubular chamber, so that the residual gas charge in the dielectric tubular chamber is ionized along its internal wall and polarized, providing repulsive forces on the walls and attractive forces on the axis, which are capable of focusing electrostatically the beam of charged particles that leaves the dielectric tubular chamber.

The above cited phenomenon of ablation can be performed with a commercially available device known as Channel Spark Ablator (CSA), supplied for example by Neocera Inc. This device utilizes the properties of electrical discharges in low-pressure gases. With reference to FIG. 1, which illustrates schematically such a device, the electron beam is generated as follows.

The system shown in FIG. 1 is connected to a vacuum system and is kept at a pressure ranging from 1.5 to 3.5 Pa (1.5 to $3.5\times10^{-2}$ mbars). A high-voltage DC generator (10-20 kV, 5 mA) is arranged between the hollow cathode (1) and the ground across the bank of capacitors (10-20 nF) (2) and keeps the cathode (1) at a negative voltage with respect to the ground. When the voltage between the cathode and the ground exceeds the discharge value of an air gap device (3), an air spark is induced in said device. This discharge rapidly brings the electrode (13), arranged at the base of the trigger tube (4), to a nil potential. The difference in potential between the trigger electrode (13) and the hollow cathode (1) triggers a discharge in the gas contained in the trigger tube (4), which is focused further by the possible presence of an annular permanent magnet (5). The positive ions of the gas are accelerated toward the base and the walls of the cathode and strike them with enough energy to extract electrons. The expelled electrons feel the acceleration of the electrical field, which propels them to the right in the drawing, and are forced to enter the channel (6) made of insulating material (7), which directs them toward the target (8). Owing to the presence of ionized gas, the charge of the electrons is spatially shielded: the density of the electrons along the axis of the device reaches very high values and the instantaneous current reaches values on the order of $10^4$ A even in the free path portion (9). Due to the dynamics of the discharge, the electrons stripped during the first steps of said discharge are slower than the ones stripped in the final steps, and therefore there is an accumulation effect (the slow ones start earlier and are reached by the fast ones) which leads to the formation of a pulse which has a clearly defined duration (approximately 100 nsec). The electron pulse strikes the target (8), penetrates a few microns below the surface, and releases the energy (approximately 1 J per pulse), giving rise to an ablation of material which is collected on a substrate (10) arranged at an appropriate distance.

Although this device is effective, some problems and limitations are observed, including the fact that part of the useful energy of the capacitors is used to supply the predischarge in the air gap across resistors (11). Moreover, the discharge time is determined by the release of the spark in the air gap, and this depends on several factors which cannot be controlled, such as the microscopic cleanness of the points (12) of the air gap, the composition, pressure and especially the humidity of the ambient air, and cannot be predetermined accurately.

Moreover, the pressure in the vacuum chamber must be kept within an extremely limited range.

Many materials in fact cannot be deposited in the form of a thin film within this pressure range: generally, pressures much lower than 1 Pa ($10^{-2}$ mbars) are needed.

SUMMARY OF THE INVENTION

The aim of the present invention is therefore to eliminate the drawbacks noted above in known types of apparatuses and processes for generating, accelerating and propagating beams of charged particles, by providing an apparatus and a process which allow to obtain a beam of electrons and plasma with a higher energy density in the beam with respect to the energy supplied to the system.

Another object of the present invention is to provide an apparatus and a process for generating beams of electrons and plasma, adapted to achieve ablation of materials from a target with higher efficiency, by using reduced acceleration voltages, particularly lower than 10 kV.

Another object of the present invention is to provide an apparatus and a method which allow to deposit, in the form of a film or in other forms, highly volatile materials, such as organic materials.

This aim and these and other objects, which will become better apparent from the description that follows, are achieved, according to the present invention, with an apparatus and processes as defined in the appended claims.

An apparatus for generating, accelerating and propagating beams of electrons and plasma according to the invention comprises: a first dielectric tube, which contains gas; a hollow cathode, which is connected to said first dielectric tube; a second dielectric tube, which is connected to said hollow cathode and protrudes into a deposition chamber and is connected thereto; said first dielectric tube, said hollow cathode and said second dielectric tube being interconnected by means of hermetic vacuum couplings and gaskets so as to form a single container for the gas; an anode arranged around said second dielectric tube; means for applying voltage to said cathode and to said anode; means for evacuating the gas from said chamber; and means for spontaneous converting into plasma the gas in the first dielectric tube.

Preferably, in the apparatus according to the present invention, the means for spontaneous conversion of the gas into plasma comprise means adapted to provide a pressure of the gas in the first dielectric tube and a cathode voltage which are adapted, in combination, to determine said spontaneous conversion of the gas into plasma.

The means for spontaneous conversion of the gas can comprise, for example, means adapted to provide a pressure of the gas within the first dielectric tube in the range of 0.5-10 Pa. The means for spontaneous conversion of the gas can comprise, for example, means adapted to generate a cathode voltage between 1 and 30 kV.

In an exemplifying but nonlimiting embodiment of the apparatus according to the present invention, the means for the spontaneous conversion of the gas comprises a needle valve or another suitable type of control/regulation valve, which is arranged on a duct for the inflow of the gas into the first dielectric tube, and a high-voltage generator (for example, a generator adapted to generate a voltage between 1 and 30 kV).

The apparatus according to the invention may further comprise means for controlling the beginning of the spontaneous conversion of the gas into plasma in the dielectric tube.

The means for controlling the start of the conversion can comprise means for inducing an electromagnetic field which is adapted to cause from outside the ionization of the gas contained in the first dielectric tube.

The induction means can be, preferably but not exclusively, selected among antennas suitable for applying voltage pulses, piezoelectric generators, antennas, preferably miniaturized ones, for microwaves, radio frequency coils, small pulsed lasers or devices for generating optical pulses.

An antenna can be arranged proximate to, or in contact with, the outside walls of said first dielectric tube or within a few millimeters from them, and in particular can be a linear antenna arranged in a cavity provided by the outer wall of the first tube or a coiled antenna arranged around the outside wall of said first tube.

The apparatus according to the invention may further comprise means adapted to maintain, within the deposition chamber, a pressure which is lower than the pressure within the first dielectric tube.

In a particular embodiment, the pressure to be maintained within the deposition chamber can be lower than 1 Pa, preferably around $10^{-4}$ Pa, or even lower than $10^{-4}$ Pa.

The means for maintaining a low pressure in the deposition chamber can comprise a port for connection between the inside of the hollow cathode and the second dielectric tube having a selected cross-section, said selected cross-section of the port being smaller, particularly 5 to 100 times smaller, than the internal transverse cross-section of the hollow cathode and of the second dielectric tube.

The means for maintaining a lower pressure within the deposition chamber may further comprise a further constriction, having a diameter which is smaller than the inside diameter of the hollow cathode and of the second dielectric tube, located between a first end portion and a second end portion of the second dielectric tube.

Refocusing means are further provided advantageously in order to maintain the focus of the beam; said means can comprise a pile constituted by one or more metallic disks separated by insulating disks, the metallic and insulating disks being each provided with a central hole and being aligned so as to form a central channel within the pile. Preferably, the pile is arranged between a first end portion and a second end portion of the second dielectric tube and is located between the output of the cathode and the anode.

Another aspect of the present invention relates to a process for generating, accelerating and propagating beams of electrons and plasma, which comprises the steps of:

supplying a first dielectric tube containing gas, a hollow cathode connected to said first dielectric tube, a second dielectric tube, which is connected to said hollow cathode and protrudes into, and is connected to, a deposition chamber, and an anode arranged around said second dielectric tube;

applying voltages to said cathode and said anode;

evacuating gas from said chamber; and inducing in a controlled manner a spontaneous conversion of the gas in said first dielectric tube into plasma, thus generating a pulsed beam of electrons which passes through the cathode and the portion of the second dielectric tube that is comprised between the cathode and the anode and further propagates along the second dielectric tube, where it generates additional plasma having high density and enters said chamber with said plasma.

Preferably, the step of spontaneous conversion is provided by adjusting the pressure of said gas in the first dielectric tube and the voltage applied to the hollow cathode to values which, in combination, are adapted to produce said spontaneous conversion.

The generation of a spontaneous discharge at a set value of the electrical field is linked to the geometrical dimensions of the cathode, to the dielectric properties of the gas and to the pressure thereof by means of the known Paschen law, which establishes the relationship between the discharge voltage in the gas interposed between the two plates of a capacitor at the charging voltage of the capacitor, its geometry and the pressure of the gas, substantially reflecting the dependency of the electrical conductivity in the gas on the value of the pressure. It is in fact known that for any kind of gas, its ionizability for an equal external electrical field has a conspicuous peak at pressures in the range 0.1-10 Pa. This occurs because at high pressure the mean free path of the gas molecules subjected to an electrical field is not sufficient to supply the minimum energy for generating an ion in the collision between two molecules, whereas at very low pressures the probability of collisions between molecules tends to equal the probability of recombination of the ions. Accordingly, for the geometry of the anode and cathode pair used, if the pressure of the gas is set in the range in which its ionizability is the highest, and if the voltage applied to the electrodes is increased, a value of the voltage is achieved for which the gas ionizes completely, forming a plasma and giving rise to an electrical discharge. The closer the pressure of the gas to the maximum ionizability value, the lower the voltage required to generate the discharge.

This process may further comprise a step for controlling the beginning of the spontaneous conversion of the gas into plasma.

Control can be provided, for example, by applying a voltage pulse, defined as a voltage variation which is fast enough to be comparable with the typical durations of the spontaneous discharge induced in the gas, or having rise/fall times of no more than 1 msec, to an antenna located proximate to the outside wall of said first dielectric tube. As an alternative, it is possible to apply a microwave pulse defined as a variation in the intensity of a microwave field which is fast enough to be comparable with the typical durations of the spontaneous discharge induced in the gas, i.e., having rise/fall times of no more than 1 msec, by means of an antenna located proximate to the outside wall of said dielectric tube. In another possible embodiment, a portion of the dielectric tube is arranged within a microwave resonant cavity. In yet another embodiment, the gas in the dielectric tube is illuminated with an intense beam of photons, which have an energy sufficient to ionize it and an intensity which induces the conversion of the gas into plasma.

Preferably, said process according to the invention comprises maintaining in said deposition chamber a pressure which is lower than the pressure in the first dielectric tube.

Moreover, said process can comprise the refocusing of the beam of electrons which passes through the second dielectric tube.

Refocusing can be provided by means of the passage of the beam of electrons through a pile of one or more metallic disks separated by insulating disks, said metallic and insulating disks each having a central hole and being aligned so as to form a central channel in said pile, which is arranged between a first end portion and a second end portion of the second dielectric tube, and said hole having a diameter which is smaller than the inside diameter of said first and second portions of said second dielectric tube.

Another aspect of the present invention relates to a method for ablating a material from a target made of said material, which comprises striking said target with a beam of electrons and plasma at high density, which are generated, accelerated and propagated with a process for generating, accelerating and propagating beams of electrons and plasma according to the invention, so that the energy deposited by the beam on the target causes an emission of material, in the form of neutral and ionized atoms, molecules, radicals, clusters of atoms and amorphous and crystalline aggregates, with a conoid distribution whose axis is perpendicular to the surface of the target.

In another aspect, the present invention provides a process for depositing a film of a material, which comprises the steps of ablating said material from a target made of said material, by means of a process for ablating material from a target according to the invention, and depositing the emitted material on a suitable support located so as to intercept the conoid of emission of the material from the target.

Another aspect of the present invention provides a process for producing nanostructured aggregates of a material, which comprises the steps of ablating said material, from a target made of said material, by means of a process for ablating material from a target according to the present invention, condensing the material emitted during its flight time and collecting said material on a cooled surface arranged along the mean path of the emitted material or on a filter of suitable porosity located across the mean path of the emitted material.

BRIEF DESCRIPTION OF THE DRAWINGS

Further characteristics and advantages of the present invention will become better apparent from the description of a preferred but not exclusive embodiment, illustrated by way of non-limiting example in the accompanying drawings, wherein.

DESCRIPTION OF THE PREFERRED EMBODIMENTS

Figure 1:
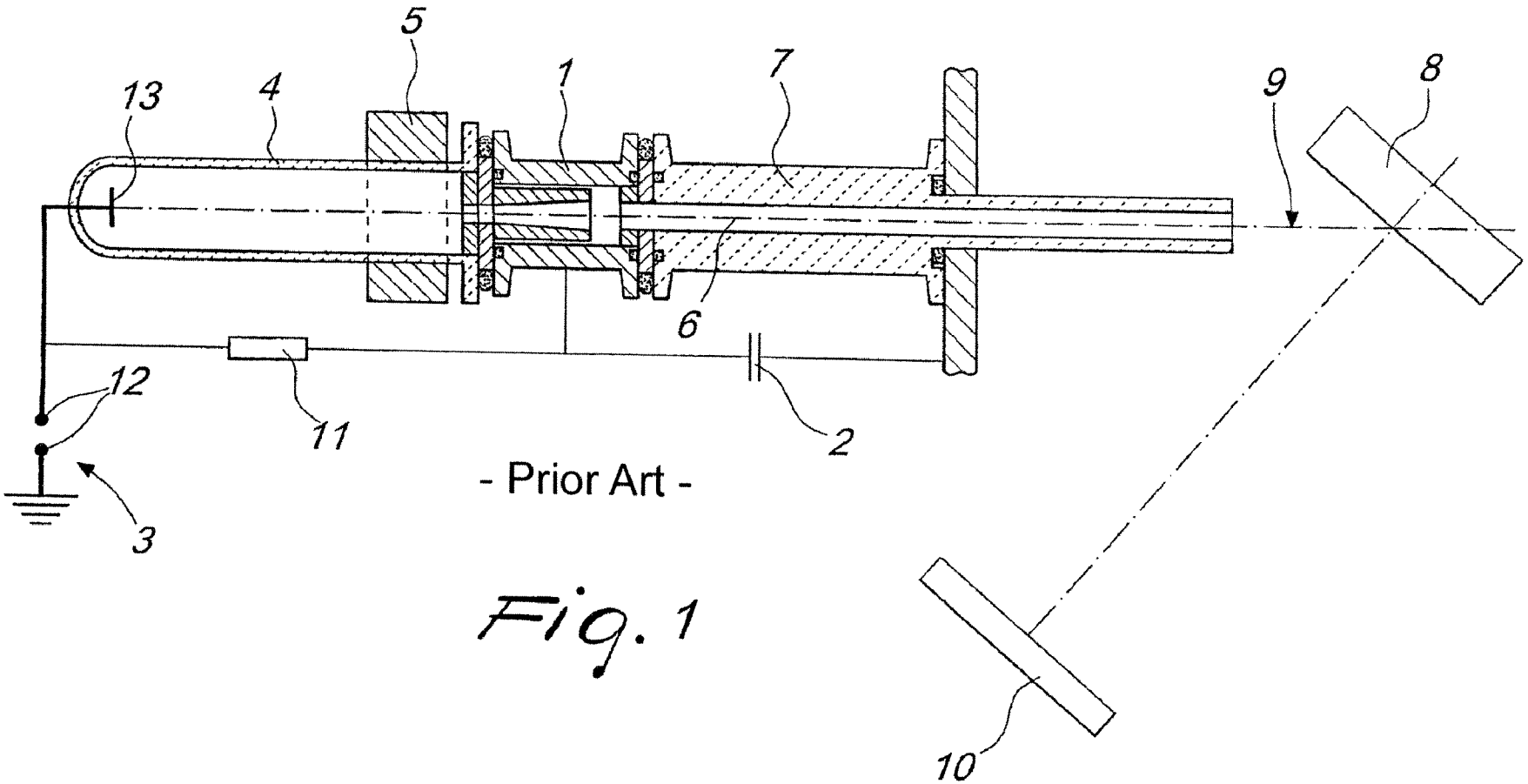
FIG. 1 is a schematic view of an ablation device of the background art.
Figure 2:
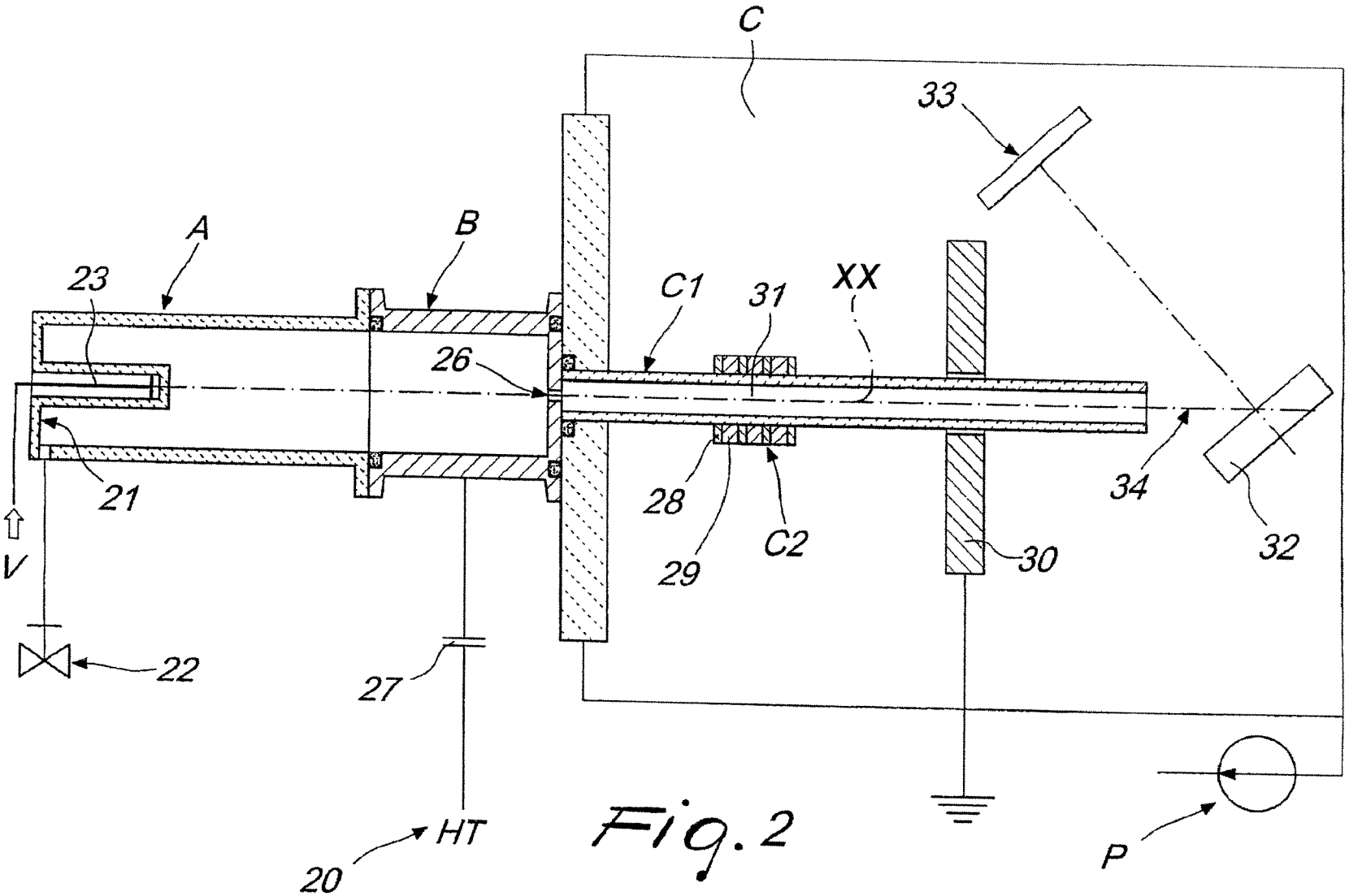
FIG. 2 is a schematic view of an apparatus for generating, accelerating and propagating beams of electrons and plasma according to a preferred but not exclusive embodiment of the apparatus of the present invention.
Figure 3:
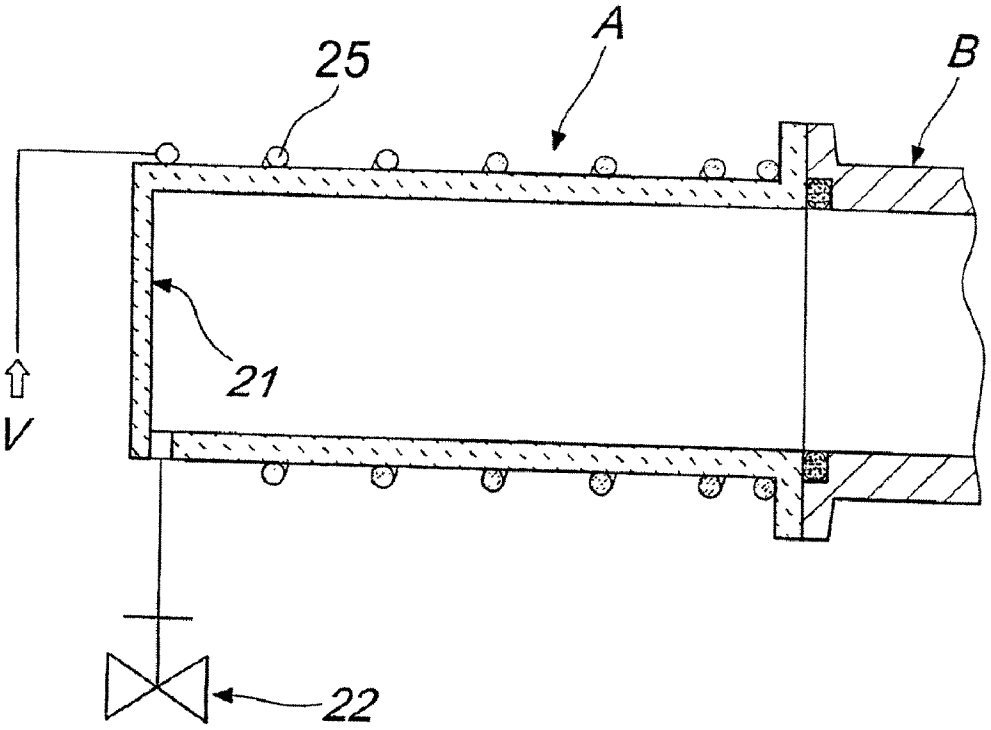
FIG. 3 is a partial schematic view of the discharge tube in an alternative embodiment thereof.

With reference to FIGS. 2 to 3, the apparatus (20) comprises a discharge tube A for the plasma, which is made of glass or other dielectric material. This tube has the main purpose of containing an amount of gas which is sufficient to supply the number of ions required to trigger and maintain the main electrical discharge in a hollow cathode B which is connected hermetically thereto.

The pressure of the gas at the bottom (21) of the tube A is maximum with respect to the pressures that occur in the other parts of the apparatus. By means of a needle valve (22), which is connected to the tube (A), and upstream of which the pressure is equal to, or greater than, the atmospheric value, a stream of gas is in fact generated which flows from the bottom (21) of the tube A, through the hollow cathode B, enters a second dielectric tube C1 and then enters the deposition chamber C, which is connected hermetically to the cathode and downstream of which there are gas evacuation means, which are constituted by a vacuum pumping system P. Both dielectric tubes A and C1, for the sake of simplicity, will be referenced hereinafter as "dielectric tube" A and C1.

The gas contained in the tube A is converted into plasma by means for spontaneous conversion of the gas, which are constituted by the needle valve 22 and by the electrostatic voltage generated between the hollow cathode B and the surrounding environment. This conversion can occur spontaneously for certain pairs of values of applied voltage/local pressure of the gas, according to Paschen's law (typical values are 10 kV, 5 Pa) and is referenced here as self-discharge.

Self-discharge is facilitated by means for controlling the start of the spontaneous conversion of the gas and in particular by a voltage pulse V, which is applied to a linear antenna (23) arranged in the cavity (24) or to a coiled antenna (25) which is wound around the tube A (see FIG. 3).

The controlled generation of pulses at the antennas (23 or 25), which constitute an embodiment of the control means, allows for the control the beginning of the discharge of the tube A, which is kept in self-discharge conditions.

The external pulse, therefore, provides only the moment when self-discharge starts, without absorbing even slightly the energy that is used or can be used by said discharge.

The hollow cathode B can be similar to known devices which are used universally in the field of the generation of collimated electron beams. The hollow cathode B used in the present invention is for example a hollow metallic device with geometric proportions between the diameter of the cavity, the length, the radius of curvature of the dome, as described in publicly available literature. At the output end of the electron beam of the cathode there are means for maintaining a low pressure in the deposition chamber C, which comprise a constriction provided by a port (26) which has a smaller cross-section than the tubes A and C1. This constriction eliminates from the beam many of the electrons that have not been accelerated exactly along the axis X-X of the device. The hollow cathode B is connected to means for applying voltage, which are constituted by a high voltage generator HT, across a bank of capacitors (27) capable of supplying the energy required for self-discharge and the acceleration voltage for the electrons that are accelerated.

The apparatus shown schematically in FIG. 2 further comprises the second dielectric tube C1, in which the acceleration of the electrons occurs first, followed by the propagation of the beam of electrons and plasma at high density, and a stack of perforated disks (28), particularly metallic disks, which are separated by insulating disks (29), for focusing and collimating the beam, said stack being designated by the reference sign C2.

The inventors of the present invention have found that the use of a dielectric tube C1, which has a larger transverse cross-section than the cross-section of the port (26), allows excellent characteristics of propagation of beams of electrons and plasma to be obtained. The inventors have also found that said excellent propagation characteristics are maintained while the beam is refocused by using refocusing means constituted, in a possible but not exclusive embodiment, by a stack of perforated disks C2, which is formed by metallic disks (28), which are mutually separated by insulating disks (29) and are arranged in this grouped configuration between a first portion and a second portion of the dielectric tube C1. The disks are placed at electrostatic voltages which are intermediate between the voltages of the cathode B and the ground reference constituted by the anode (30).

The disks (28, 29) have a central hole, which has a transverse cross-section dC2 which is equal to, or slightly greater than, the transverse cross-section dB of the port 26, since they are centered on the axis XX of the second dielectric tube, so that they form a central channel 31. The field that they generate is such as to realign the axial component of the motion of the electron beam.

If the channel 31 has a reduced cross-section, approximately equal to the cross-section of the port 26, it constitutes, together with the first port 26, the means for maintaining a low pressure within the chamber C.

The realignment effect allows the current of the beam to be maintained at a high value (higher number of electrons with the correct direction of motion), allowing the use of an output channel whose diameter is wide enough to allow easy ballistic propagation of the beam of electrons and plasma at high density.

Figure 4:
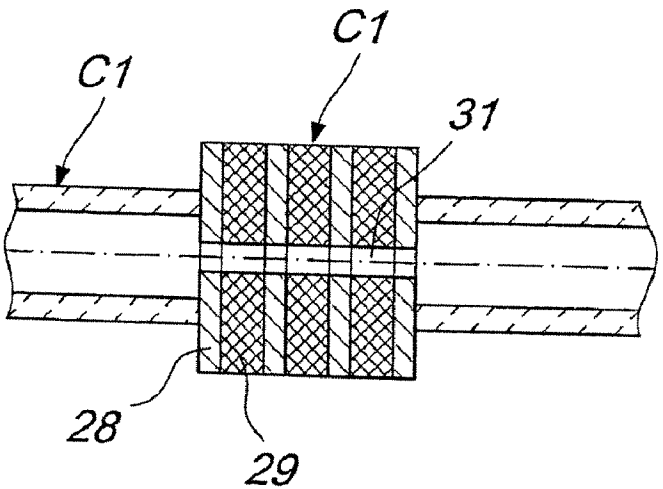
FIG. 4 is a schematic partial view of the dielectric tube in an alternative embodiment thereof.

It is further possible to provide the disks 28, 29 with a central hole 31 whose cross-section is approximately equal to the outside cross-section of the dielectric tube C1, so that the stack of disks C2 can be arranged around the tube C1 (see FIG. 4). The number of metallic disks 28 and accordingly of the insulating disks 29 can be changed according to the length of the dielectric tube C1 and of the electrical field covered region that is to be provided for optimum collimation and acceleration of the beam of electrons and plasma.

With the apparatus according to the present invention it has therefore been shown that it is possible to render the pressure in the device that generates the discharge independent of the pressure of the cathode and of the deposition chamber C, providing a differential gas emission system by means of a controlled leak (needle valve 22). The apparatus according to the present invention allows a positive pressure difference to be maintained between the discharge tube and the plasma tube A and the deposition chamber C, which can contain a target 32 and the substrate 33 and is connected to the pumping system P.

Surprisingly, it has been found that by adjusting the opening of the needle valve so as to obtain, in the first dielectric tube, pressures ranging from 0.5 Pa to 10 Pa (therefore for definite values of the pressure gradient along the second dielectric tube C1), and that by applying a voltage to the cathode it was possible to generate a discharge of electrons and plasma having such characteristics as to produce ablation on a target, simply by feeding the capacitors (27) at a voltage that has been established to be sufficient and in any case is not higher than the usual voltages used in the devices of the background art. Accordingly, a trigger circuit is completely unnecessary. This phenomenon, termed here "self-spark ablation", differs substantially from the method and device described in the literature, since the ions and electrons that trigger the discharge are generated directly in the hollow cathode, by virtue of the electrical field and pressure gradients, the conductivity of the gas in this pressure range depending heavily on said pressure.

Since the pressure in the hollow cathode B and in the channel 31 is regulated by the opening of the needle valve (22), the pressure range of the chamber C which contains the target 32 and the substrate 33, in which the phenomenon of ablation is observed, is rendered independent of the limited values of the background art in which it is possible to generate the electron pulses. While the pressure within the gas that passes through the needle valve (22) might be kept at around 1 Pa, the average pressure in the deposition chamber might in fact be lowered to $10^{-4}$ Pa.

Moreover, since all the energy stored in the capacitors (27) is discharged toward the target, the energy of the beam of electrons and plasma that produce ablation is higher. Accordingly, it is possible to achieve ablation at an acceleration voltage lower than 10 kV, which is impossible with the channel-spark method. Accordingly, the apparatus and process according to the present invention allow to deposit more volatile materials, such as organic materials.

Moreover, the inventors of the present invention have found that the self-spark system can be triggered effectively simply in a step for controlling the spontaneous conversion of the gas into plasma by sending from outside any electromagnetic field, of the electrostatic or radio frequency or microwave type, or by means of photons in the visible and/or UV range.

It is further possible to place a portion of the dielectric tube A in a resonant cavity of the known type.

The onset of an electrical disturbance without the need for contacts of any kind generates a charge disproportion which, though very low, is sufficient to drive the triggering of self-sparking.

The material on which the dielectric tube A is provided is in any case such as to not obstruct the phenomenon of pulsing in each one of the modes used.

Accordingly, the apparatus according to the present invention can utilize fields generated not only by the antennas 23, 25 but also by other ionization means, such as piezoelectric means, miniaturized antennas for microwaves, optical pulse generators, radio frequency coils, small pulsed lasers, in order to generate beams of electrons and plasma capable of ablating a wide variety of materials, such as even high-melting-point metals (rhodium, titanium, tantalum), ceramic and glass-like materials (perovskites, carbides, nitrides, corundum, refractory oxides, borosilicate glass) and organic materials (Teflon®, sulfurated oligomers).

In practice it has been found that, for example, by using an electronic starter circuit for cars, chosen for its reliability and low cost, driven by a simple circuit which oscillates at a variable frequency, it is possible to obtain, with the apparatus according to the present invention, pulses of electrons and plasma at high density with a pulse duration on the order of 100 nsec and with a frequency which can be preset between 0.01 Hz and 100 Hz. These pulses are capable of generating ablation with acceleration ranges for the electrons from 1.5 kV to 25 kV (limit of the power supply and of the capacitors used in the experiment). The average pressure in the deposition chamber can be kept at any value in the range from $10^{-4}$ Pa to 1 Pa, thus providing a self-spark ablator (SSA) which allows practically universal use.

In another aspect, the present invention provides an apparatus and a method for ablating material from a target and for the possible additional deposition of the material produced by the ablation in the form of a film, specifically thin films, or collection of the material produced by ablation in the form of micro- or nanoclusters.

Such an apparatus according to the present invention comprises an apparatus for generating, accelerating and propagating a pulsed beam of electrons and plasma according to the invention as described above, in which in the deposition chamber C there is a target 32, constituted by a material to be ablated, and there is a support 33 for depositing and collecting the material produced by ablation. The target 32 is located in a position which is suitable for being struck by the beam of electrons and plasma 34 and for transferring the removed material toward the support 33. Once the target 32 has been struck so that ablation of material from the target 32 occurs, the material removed by ablation is transferred or propelled at right angles to the target 32 toward the support 33.

In principle, it is possible to use any gas or gas mixture. The type of gas can be chosen as a function of the material to be ablated or deposited. For example, $O_2$, Ar, $Ar^+$, 1% $H_2$ $N_2$, air, Kr, Xe have been used. The energy deposited on the target depends also on the molecular mass of the gas.

Example of Deposition

Gas: argon; supply pressure: 1.2 bar; needle valve flow rate: $10^{-6}$ mbar*l/sec; volume of the first dielectric tube: 26 $cm^3$; discharge voltage: 12.5 kV; discharge repetition: 2.7 Hz; discharge control: by means of a coil supplied with pulses of 1.5 kV lasting 250 nsec; length of second dielectric tube: 110 mm; cross-section of second dielectric tube 6 $mm^2$; volume of deposition chamber: 35 $dm^3$; pumping rate: 60 l/min; target material: cerium oxide; distance of second dielectric tube to target: 3 mm; substrate: sapphire; distance of target to substrate: 6 cm; deposition time: 20 minutes; layer of cerium oxide deposited: 960 nm on a surface of 1.44 $cm^2$.

In a variation of application, nanotubes are formed from the material ablated from the target, which forms deposits of nanoaggregates of the nanocluster type.

In practice it has thus been found that the apparatus and the processes described can provide effectively beams of electrons and plasma which are capable of ablating material to provide a production of nanoclusters.

The persons skilled in the art will understand that the characteristics of the apparatus described in a preferred embodiment thereof may be replaced with other technically equivalent ones, all of which however are within the scope of the appended claims.

The disclosures in Italian Patent Application No. MI2005A000585 from which this application claims priority are incorporated herein by reference.

What is claimed is:

1. An apparatus for generating, accelerating and propagating beams of electrons and plasma at high density, comprising:

a first dielectric tube, which contains gas;

a hollow cathode, which is connected hermetically to said first dielectric tube;

a second dielectric tube, which is connected hermetically to said hollow cathode and protrudes inside, and is connected to, a deposition chamber;

an anode, which is arranged around said second dielectric tube, in an intermediate position;

means for applying voltage to said cathode and said anode;

means for evacuating the gas from said deposition chamber so that the pressure in the deposition chamber is lower than the pressure within the first dielectric tube;

means for the spontaneous conversion of the gas into plasma within the first dielectric tube; and control means for controlling the beginning of the spontaneous conversion of the gas into plasma in the first dielectric tube, said control means comprising means for ionization by induction of an electromagnetic field suitable to produce ionization of the gas.

2. The apparatus according to claim 1, wherein said means for spontaneous conversion of the gas into plasma comprise means for providing a pressure of the gas in the first dielectric tube and a voltage of the cathode which are adapted, in combination, to determine said spontaneous conversion, the means for evacuating the gas being connected to the deposition chamber, which connects the second dielectric tube and the evacuating means.

3. The apparatus according to claim 2, wherein said means for spontaneous conversion comprise a needle valve, which is arranged on a duct for the inflow of the gas into said first dielectric tube, and the means for applying voltage, which are constituted by a high-voltage generator.

4. The apparatus according to claim 1, wherein said control means comprise an antenna suitable to apply voltage pulses.

5. The apparatus according to claim 1, wherein said ionization means comprise a device for generating optical pulses or an antenna suitable to apply microwave pulses.

6. The apparatus according to claim 4, wherein said antenna is arranged proximate to the outside walls of said first dielectric tube and is constituted in particular by a linear antenna, which is arranged in a hollow receptacle formed by the outside wall of said first tube, or by a coiled antenna, which is arranged around the outside wall of said first tube.

7. The apparatus according to claim 1, further comprising means for hindering the passage of gas between an inside of the cathode to an inside of the deposition chamber so as to contribute to maintain low pressure in the deposition chamber, said low pressure being a pressure which is lower than the pressure within the first dielectric tube; the means for evacuating the gas being connected to the deposition chamber, which connects the second dielectric tube and the evacuating means.

8. The apparatus according to claim 7, wherein said means for evacuating the gas and said means for hindering the passage of gas are adapted to maintain, within the deposition chamber, a pressure lower than 1 Pa.

9. The apparatus according to claim 7, wherein said means for hindering the passage of gas comprise a constriction constituted by a port for connection between the inside of the hollow cathode and the second dielectric tube, said port having an internal cross-section which is smaller than the transverse internal cross-section of the hollow cathode and the internal cross-section of the second dielectric tube.

10. The apparatus according to claim 7, wherein said means for hindering the passage of gas further comprise a central channel, the cross-section of which is smaller than the internal cross section of the hollow cathode and the internal cross-section of the second dielectric tube, said channel being arranged between a first end portion and a second end portion of the second dielectric tube.

11. The apparatus according to claim 1, further comprising refocusing means for maintaining the focus of the beam of electrons and plasma in the second dielectric tube.

12. The apparatus according to claim 11, wherein said means for maintaining focus comprise a pile constituted by one or more metallic disks separated by insulating disks, said metallic and insulating disks each having a central hole and being centered on the axis of the second dielectric tube so as to form said central channel, said pile being arranged between a first portion and a second portion of the second dielectric tube.

13. The apparatus according to claim 10, wherein said means for maintaining low pressure comprise a constriction constituted by a port for connection between the inside of the hollow cathode and the second dielectric tube, said port having an internal cross-section which is smaller than the transverse internal cross-section of the hollow cathode and the internal cross-section of the second dielectric tube, said central channel has a cross-section equal to, or greater than, the cross-section of said port for exit from the hollow cathode.

14. A process for generating, accelerating and propagating beams of electrons and plasma at high density, comprising:

supplying a first dielectric tube containing gas, a hollow cathode connected to said first dielectric tube, a second dielectric tube which is connected to said hollow cathode and protrudes within, and is connected to, a deposition chamber, and an anode arranged around said second dielectric tube applying voltage to said cathode and said anode;

evacuating gas from said chamber so that the pressure in the deposition chamber is lower than the pressure within the first dielectric tube and the cathode;

inducing in a controlled manner a spontaneous conversion of the gas in said first dielectric tube into plasma, thus generating a pulsed beam of electrons which passes through said cathode and said second dielectric tube, where in turn it generates high-density plasma, which enters said chamber together with the electrons; and controlling the start of said spontaneous conversion by providing an electromagnetic pulse suitable to produce ionization of the gas.

15. The process according to claim 14, wherein said step of spontaneous conversion is performed by adjusting the pressure of the gas in said first dielectric tube and the voltage applied to the hollow cathode to calibrated values which, in combination, are suitable to determine said spontaneous conversion.

16. The process according to claim 14, wherein said electromagnetic pulse is provided by applying a voltage pulse to an antenna arranged proximate to the outside wall of said first dielectric tube.

17. The process according to claim 14, wherein said electromagnetic pulse is provided by applying a microwave pulse by virtue of an antenna arranged proximate to the outside wall of said first dielectric tube or by placing a portion of said first tube within a microwave resonant cavity.

18. The process according to claim 14, wherein said electromagnetic pulse is provided by directing an optical pulse constituted by photons of the visible and/or UV spectrum and/or having an energy adapted to determine the start of said spontaneous conversion through said first dielectric tube, said dielectric tube being provided in such a material as to not obstruct the radiation used.

19. The process according to claim 14, further comprising maintaining, in said deposition chamber, a pressure which is lower than the pressure in the first dielectric tube and is lower than 1 Pa.

20. The process according to claim 14, further comprising the refocusing of the beam of electrons and plasma which passes through the second dielectric tube.

21. The process according to claim 20, wherein said refocusing is provided by means of the passage of the beam of electrons and plasma through a pile formed by one or more metallic disks separated by insulating disks, said metallic and insulating disks being each provided with a central hole and being aligned so as to form a central channel, said pile being arranged between a first end portion and a second end portion of the second dielectric tube and said central channel having a cross-section which is smaller than the internal cross-section of said first and second end portions of said second dielectric tube.

22. The process for ablating a material from a target made of said material, comprising striking said target with a beam of electrons and plasma at high density generated, accelerated and propagated according to a process according to claim 14, and so that the energy deposited by said beam onto the target causes an emission of material, in the form of neutral and ionized atoms, molecules, radicals, clusters of atoms and aggregates, both amorphous and crystalline, with a conoid distribution, with an axis which is perpendicular to the surface of the target.

23. A process for depositing a film of a material, which comprises the steps of ablating said material from a target made of said material by means of a process according to claim 22 and of depositing the emitted material on a suitable support arranged so as to intercept the emission of material from the target.

24. A process for producing nanostructured aggregates of a material, which comprises the steps of: ablating said material from a target made of said material by means of a process according to claim 22; condensing the emitted material; and collecting said material on a cooled surface which has a temperature controlled so as to be kept at a temperature which is lower than a temperature of any other nearby surface, and is arranged along the path of the emitted material or on a filter of a porosity selected so that it has a pore passage aperture which is smaller than the minimum dimensions of the particles to be collected, said filter being arranged along the path of the emitted material.

25. A system for depositing on a support an ablation material ablated from a target, which comprises an apparatus according to claim 1, a target which comprises material to be ablated, and a support for depositing ablated material, said target and said support being arranged in the deposition chamber of said apparatus.

26. The system according to claim 25, wherein said target comprises a target surface which is arranged along an axis of propagation of a beam of electrons and plasma in said apparatus, said target surface being arranged with an angle of inclination of approximately 45° with respect to said axis.

27. The system according to claim 25, wherein said support has a surface for deposition of films or nanoclusters.

28. An apparatus for generating, accelerating and propagating beams of electrons and plasma at high density, comprising:

a first dielectric tube, which contains gas;

a hollow cathode, which is connected hermetically to said first dielectric tube;

a second dielectric tube, which is connected hermetically to said hollow cathode and protrudes inside, and is connected to, a deposition chamber;

an anode, which is arranged around said second dielectric tube, in an intermediate position;

means for applying voltage to said cathode and said anode;

means for evacuating the gas from said deposition chamber so that the pressure in the deposition chamber is lower than the pressure within the first dielectric tube;

means for the spontaneous conversion of the gas into plasma within the first dielectric tube; and control means for controlling the beginning of the spontaneous conversion of the gas into plasma in the first dielectric tube, said control means comprise means for ionization by induction of an electromagnetic field suitable to produce ionization of the gas, the means for evacuating the gas being connected to the deposition chamber, which connects the second dielectric tube and the evacuating means.

* * * * *

UNITED STATES PATENT AND TRADEMARK OFFICE

CERTIFICATE OF CORRECTION

PATENT NO. : 7,872,406 B2
APPLICATION NO. : 11/887649
DATED : January 18, 2011
INVENTOR(S) : Francesco C. Matacotta It is certified that error appears in the above-identified patent and that said Letters Patent is hereby corrected as shown below:

On the title page item (73), First named Assignee "Francesco Cina Matacotta" should be -- Francesco Cino Matacotta --.

Signed and Sealed this
Fourteenth Day of June, 2011

David J. Kappos

David J. Kappos
*Director of the United States Patent and Trademark Office*